United States Patent [19]

Anderson et al.

[11] Patent Number: 4,696,343

[45] Date of Patent: Sep. 29, 1987

[54] WIRELINE DUMP BAILER

[75] Inventors: Richard V. Anderson, Arlington; Wendall D. Carnes, Bedford, both of Tex.

[73] Assignee: S.I.E., Inc., Fort Worth, Tex.

[21] Appl. No.: 866,589

[22] Filed: May 23, 1986

[51] Int. Cl.[4] ..... E21B 33/132

[52] U.S. Cl. ..... 166/164; 166/169; 166/286

[58] Field of Search ..... 166/63, 69, 162–169, 166/286

[56] References Cited

U.S. PATENT DOCUMENTS

| | | | |
|---|---|---|---|
| 2,453,068 | 11/1948 | Haynes . | |
| 2,618,345 | 11/1952 | Tucker . | |
| 2,696,258 | 12/1954 | Greene | 166/286 |
| 2,896,722 | 7/1959 | Barnes . | |
| 2,956,624 | 10/1960 | Toelke . | |
| 3,105,549 | 10/1963 | Raulins . | |
| 3,187,813 | 6/1965 | Greene, Jr. | 166/162 |
| 3,481,402 | 12/1969 | Beckett . | |
| 4,421,166 | 12/1983 | Cain | 166/164 |
| 4,512,401 | 4/1985 | Bodine | 166/286 |

*Primary Examiner*—Stephen J. Novosad
*Assistant Examiner*—William P. Neuder
*Attorney, Agent, or Firm*—James E. Bradley

[57] ABSTRACT

A dump bailer is lowered on a wireline in a well through tubing for placing a cement slurry on a retainer located in the well. The dump bailer has a weight bar assembly that includes upper and lower sections that are extensible relative to each other. The upper weight bar section has an electrical contact that engages the electrical contact mounted in the upper end of the housing of the dump bailer. The lower section has a seal which separates the housing into upper and lower chambers. Cement is pumped in from the bottom, pushing the weight bar assembly upward until the contact on the upper weight bar section engages the upper contact. A detonator is located on the bottom of the lower weight bar section. Explosive force of the detonator transmits a shock wave through the cement slurry to expel a shear plug located on the bottom of the housing. The weight bar assembly pushes the cement from the slurry once this occurs.

8 Claims, 10 Drawing Figures

WIRELINE DUMP BAILER

BACKGROUND OF THE INVENTION

1. Field of the Invention

This invention relates in general to an apparatus for setting a cement plug in a well, and in particular to an apparatus lowered through tubing on wireline for forming the plug.

2. Description of the Prior Art

In an oil and gas wells, there are occasions when it is desired to set a plug in the casing above perforations to seal off the formation surrounding the perforations. This can be done by lowering a bridge plug on tubing or wireline. However, such procedure requires pulling the tubing out of the well if tubing is already in place. This procedure is time consuming, expensive, and may not be necessary.

Wireline devices are in use that are capable of being lowered through tubing and setting a cement plug below the tubing in the casing. In this procedure, a retainer is first lowered and set. The retainer is a collapsible metal device that has dogs that spring out to grip the casing wall. A fan shaped basket spreads out to retain cement dropped on the retainer. Then, a dump bailer is lowered through the tubing. When in position above the retainer, the dump bailer is actuated to dump cement onto the retainer. Often, several runs will be necessary to dump several feet of cement onto the retainer.

The dump bailers are of various types. In some, it is difficult to refill the bailer with cement as some require loading the cement slurry from the top. The tool is often 30 feet long, and normally has to be lowered into and pulled from the well through a pressure lubricator mounted to the top of the well. If top filling is required, the pressure lubricator may have to be removed and laid down for each run. Also, some dump bailers lack a positive means to push this cement out from the tool, relying only on gravity. This results in stringing the cement out through the well.

SUMMARY OF THE INVENTION

The dump bailer of this invention has convenient loading of the slurry from the bottom, as well as means for positive displacement of the cement from the tool. The dump bailer has a weight bar assembly located in it that has upper and lower extensible sections that are moveable longitudinally relative to each other. The upper weight bar section has an electrical contact that is adapted to engage an upper electrical contact mounted in the housing of the dump bailer. The lower section of the weight bar is adapted to receive an electrical detonator. The detonator is connected by wire to the lower contact mounted on the upper weight bar section.

Cement slurry is pumped in through a port at the bottom of the housing. The slurry pushes both the upper and lower weight bar sections upwardly, causing the lower contact on the upper weight bar section to electrically engage the upper contact mounted in the housing.

The lower weight bar section has a seal located around it that defines upper and lower chambers in the tool. The upper chamber is in communication with the well bore fluid for applying hydrostatic force. The cement slurry is located in the lower chamber and is also subjected to hydrostatic force. While lowering into the well, the cement slurry often will compress or shrink in volume due to gases contained in the slurry. The lower weight bar will move down to maintain the detonator in the slurry.

When electrical current is applied through the wireline, the detonator explodes, sending a shock wave through the slurry, and causing a plug to expel from the bottom. The lower weight bar section moves downwardly, then the upper weight bar section, pushing the slurry from the tool.

DESCRIPTION OF THE PREFERRED EMBODIMENT

Figure 1:
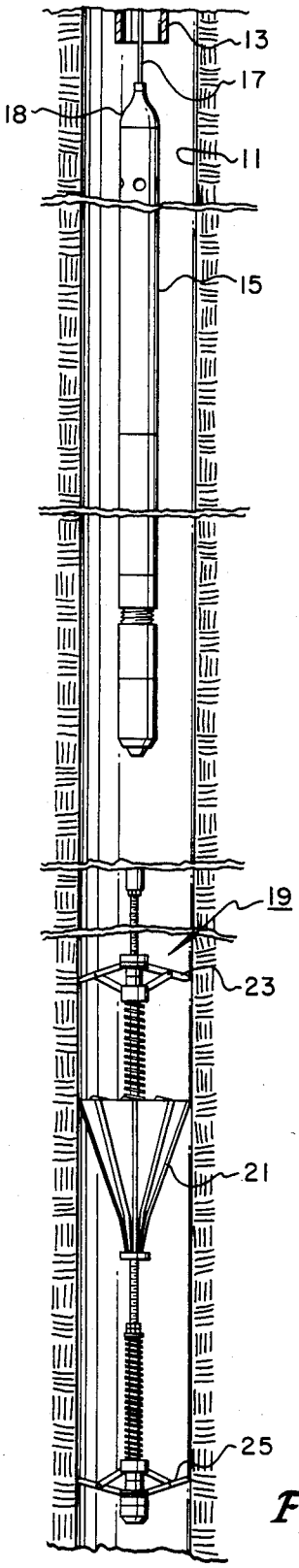
FIG. 1 is a side view showing a cement retainer positioned in a well, and a dump bailer constructed in accordance with this invention located above the retainer prior to dumping cement on the retainer.

Referring to FIG. 1, a cased well 11 is shown having tubing 13 located therein. A wireline dump bailer 15 is shown being lowered on wireline 17 to which it is connected by a connector 18. Wireline 17 normally will be single conductor cable capable of passing electrical current.

A retainer 19 has been previously positioned in the well by a setting tool (not shown). Retainer 19 is of a prior art type that is commercially available. Retainer 19 has a collapsible basket 21 that spreads out into a conical upwardly facing shape. The sides of the basket 21 will contact the sides of the cased well 11. Upper dogs 23 and lower dogs 25 frictionally engage the cased well 11 to hold the retainer 19 in place. The retainer 19 is lowered through the tubing 13 and set prior to lowering the dump bailer 15. The dump bailer 15 contains a cement slurry, which it will place to a depth of several feet of top of the basket 21 to form a cement plug.

Figure 2A:
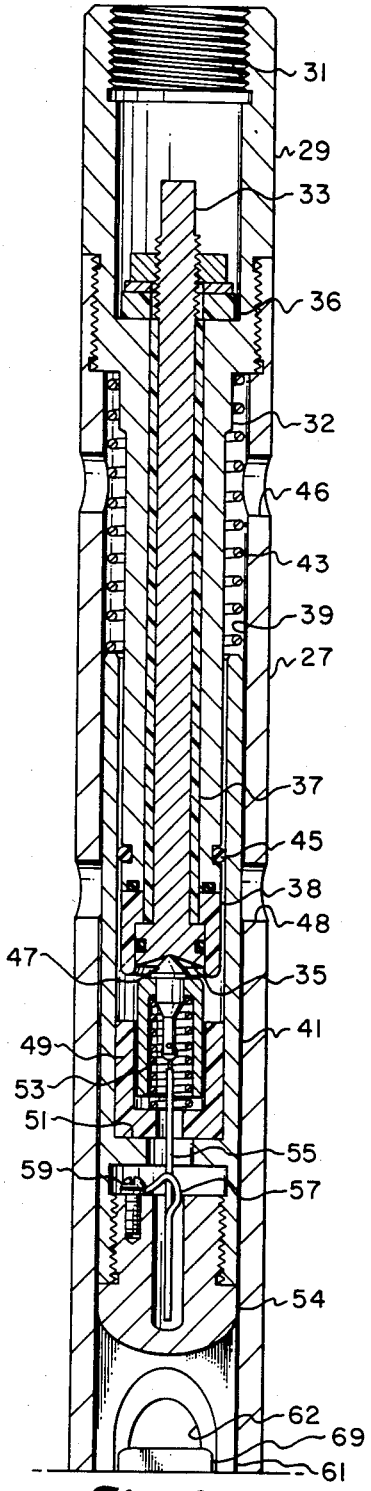
FIGS. 2A, 2B, 2C and 2D show a cross-sectional view of the dump bailer of FIG. 1.

Referring now to FIG. 2A, the dump bailer 15 has a tubular housing 27. A head sub 29 screws into the top of the housing 27. The head sub 29 has threads 31 for securing to the connector 18 of wireline 17 (FIG. 1). The head sub 29 has a tubular portion 32 that extends downwardly into the housing 27. A contact rod 33, which is an electrical conductor, extends completely through the tubular portion 32. The upper portion of the contact rod 33 is adapted to receive a socket (not shown) located in the connector 18 for electrically connecting the contact rod 33 to the wireline 17 (FIG. 1). A contact member 35 is formed on the lower end of the contact rod 33, and will be referred to herein as the upper contact member. Insulators 36, 37 and 38 electrically insulate the contact rod 33 from the head sub 29.

The tubular portion 32 of the head sub 29 is smaller in diameter than the inner diameter of the housing 27. This reults in an annular clearance 39 that extends along the length of the tubular portion 32. A socket or sleeve 41 is adapted to extend upwardly partially into this clearance 39. A spring 43 is located in the clearance. An O-ring 45 is located between the tubular member 32 and the socket 41.

A pair of upper ports 46 and 48 are located in the housing 27 adjacent the tubular member 32 for admitting well bore fluid. The outer diameter of the socket 41 is not sealed to the inner diameter of the housing 27. This allows well bore fluid to flow downwardly in the housing 27 in the spaces surrounding the socket 41. The well bore fluid, however, cannot flow into the space surrounding the upper contact member 35 because of the O-ring seal 45.

A lower electrical contact member 47 is adapted to engage the upper contact member 35 for passing electrical current. The lower contact member 47 is mounted on an insulator 49 inside the socket 41. The socket 41 has a shoulder 51 located internally within it for supporting the insulator 49. A spring 53 provides an upward bias on the lower contact member 47. Spring 53 is located within a cavity in the insulator 49.

The socket 41 is screwed onto the top of an upper weight bar or jar section 54. A wire 55 extends downwardly from the lower contact member 47 into the upper weight bar section 54. Also, a ground wire 57 extends upwardly from the upper weight bar section 54 and is securely grounded by a screw 59 screwed into the top of the upper weight bar section 54.

Figure 2B:
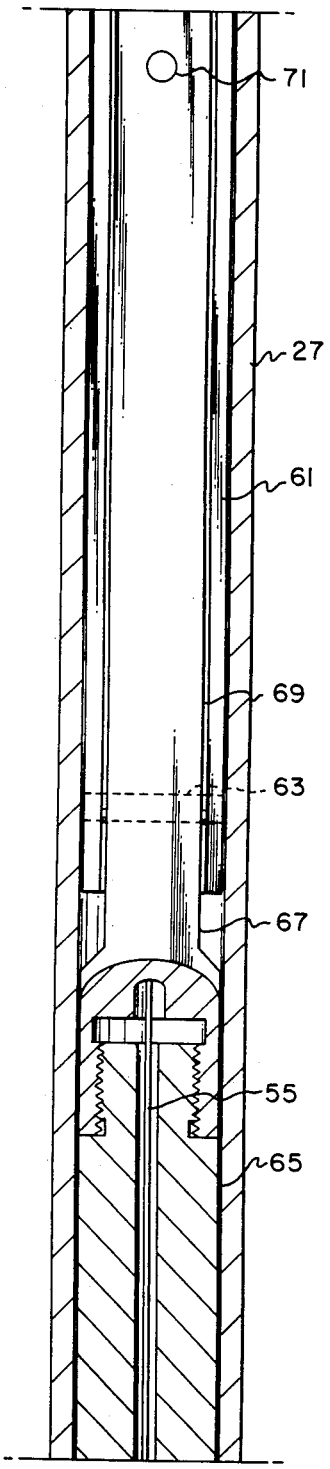

The upper weight bar section 54 is in the shape of a fork, with a pair of prongs or tines 61 that extend downwardly. The tines 61 are on opposite sides from each other and spaced apart by slots 62 which are about the same width as the times 61. A pin 63 extends between the tines 61 near the lower ends of the tines 61, as shown in FIG. 2B. The upper weight bar section 54 is slidably mounted inside the housing 27. There are no seals on the exterior of the upper weight bar section 54, and well bore fluid is allowed to pass in the spaces surrounding the upper weight bar section 54 to flow downwardly in the housing 27.

Figure 4A:
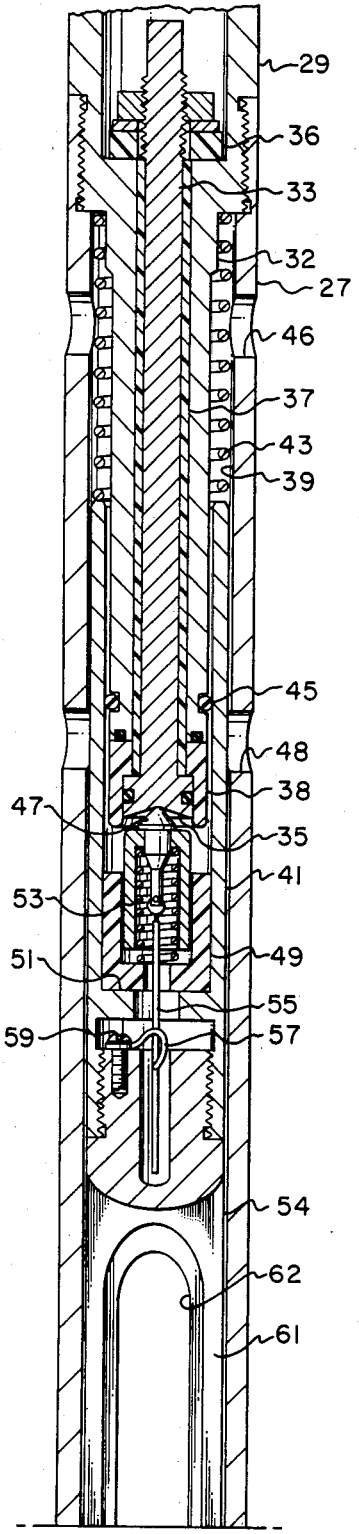
FIGS. 4A and 4B show the dump bailer of FIG. 1, with the lower weight bar section moved to a lower position relative to the upper weight bar section.
Figure 4B:
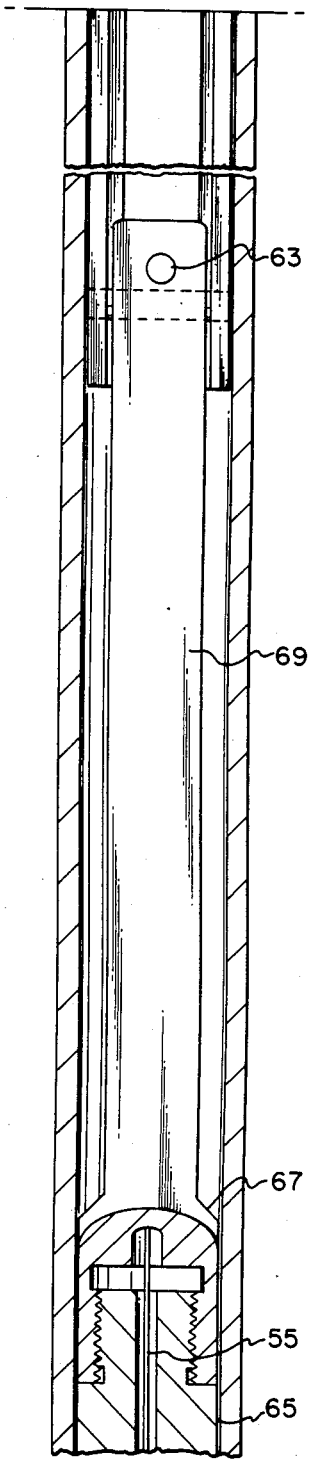

A lower weight bar or jar section 65, shown in FIG. 2B, is slidably carried in the housing 27. The lower weight bar section 65 includes on its upper end an extensible section 67 that has tines 69 that will slide within the slots 62 of the upper weight bar section 54. A pin 71 extends between the tines 69 near the upper end of the tines 69. Pin 71 is perpendicular to the pin 63. The pins 63 and 71 and tines 61 and 69 serve as connection means to allow the lower weight bar section 65 to move downwardly relative to the upper weight bar section 54 a selected distance. The tines 61 and 69 prevent rotary movement of the weight bar sections 54 and 65 relative to each other. FIG. 2B shows the lower weight bar section 65 in a retracted position relative to upper weight bar section 54. FIG. 4B shows it in an extended position relative to upper weight bar section 54. In the extended position, the pin 71 will contact the pin 63.

The lower weight bar section 65 below extensible section 67 is a cylindrical member of solid metal except for a small axial passage through which wire 55 passes. Lower weight bar section 65 serves to apply weight to push to slurry from the tool. The diameter of the lower weight bar section 65 is smaller than the inner diameter of the housing 27, allowing well bore fluid to flow downwardly into spaces surrounding the lower weight bar section 65.

Figure 2C:
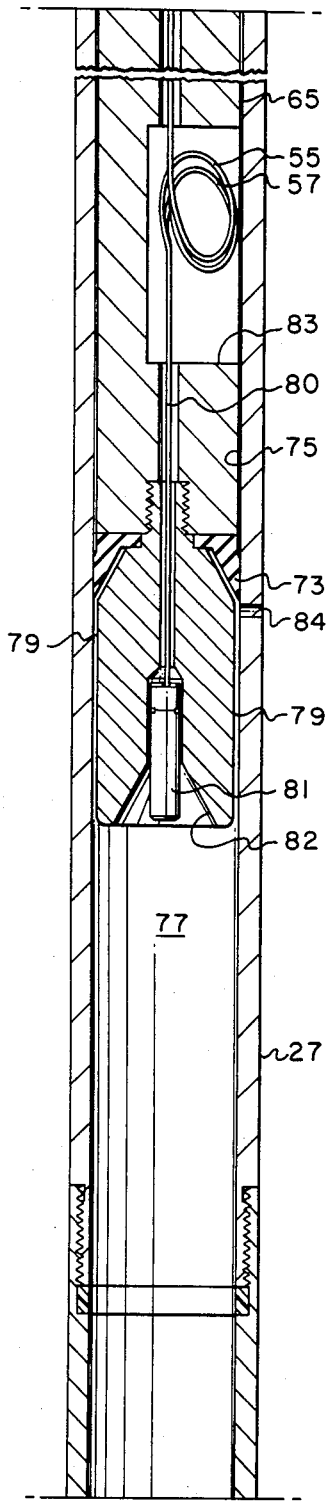

Referring to FIG. 2C, a swab cup seal 73 is located at the lower end of the lower weight bar section 65. Seal 73 seals against the inner diameter of the housing 27. This results in an upper chamber 75 which receives well bore fluid through the ports 46 and 48 (FIG. 2A) and a lower chamber 77 which will receive the cement slurry. The swab cup seal 75 acts as a piston to apply gravity force of the weight bar sections 54 and 65 to the slurry while discharging the slurry from the dump bailer 15.

A blast sleeve 79 secured by threads to the lower end of the lower weight bar section 65. The blast sleeve 79 also retains the seal 73. The blast sleeve 79 is a solid member having a small axial passage for receiving wires 55 and 57. A detonator 81 having lead wires 80 is adapted to be mounted inside the blast sleeve 79. A conical depression 82 formed in the blast sleeve 79 faces downwardly to direct the explosive force of the detonator 81 downwardly through the cement slurry.

The lower weight bar section 65 has a cavity 83 formed in its side near its lower end as shown in FIG. 2C. Cavity 83 provides convenient access to connect the wires 55 and 57 with the leads 80 of the detonator 81. A port 84 is formed in the housing 27. Port 84 is positioned so that it will be located immediately below the seal 73 when the lower weight bar section 65 is in its uppermost position as shown in FIG. 2C. Port 84 remains open even after filling to admit well bore fluid to lower chamber 77 and apply hydrostatic force.

Figure 2D:
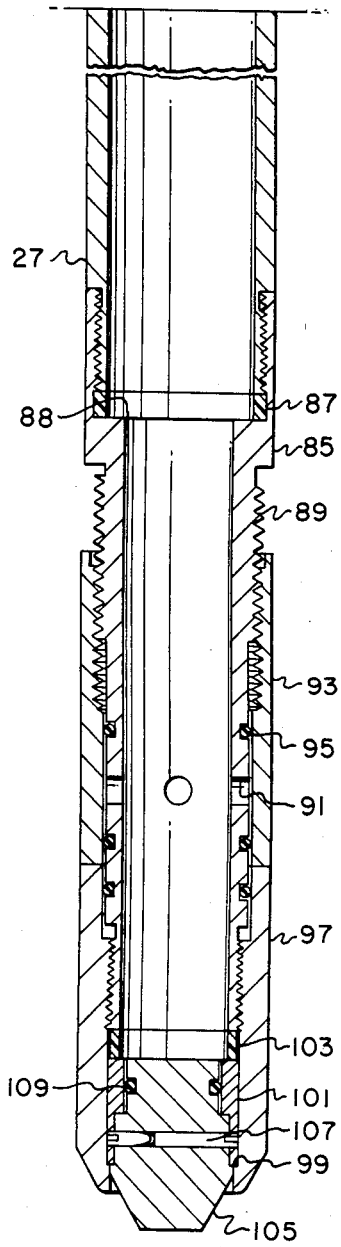

Referring to FIG. 2D, a sub 85 forms the lower end of the housing 27. It is secured by threads and sealed by a seal 87. Sub 85 has a shoulder 88 located internally therein that faces upwardly. Shoulder 88 is smaller in diameter than the inner diameter of the housing 27, and also smaller in diameter than the blast sleeve 79 to form a stop for the weight bar sections 65 and 54 when in the lower position.

The sub 85 has external threads 89 formed on it. A lower or filler port 91 is located in sub 85 below the threads 89. A sleeve valve 93 mounts on the exterior of the sub 85, engaging the threads 89. O-rings 95 are located above and below the filler port 91 for sealing against the sleeve valve 93 when it is in its closed position shown in FIG. 2D. Sleeve valve 93 can be moved upwardly to an upper position, shown if FIG. 3A, to expose the port 91 for filling.

Figure 5:
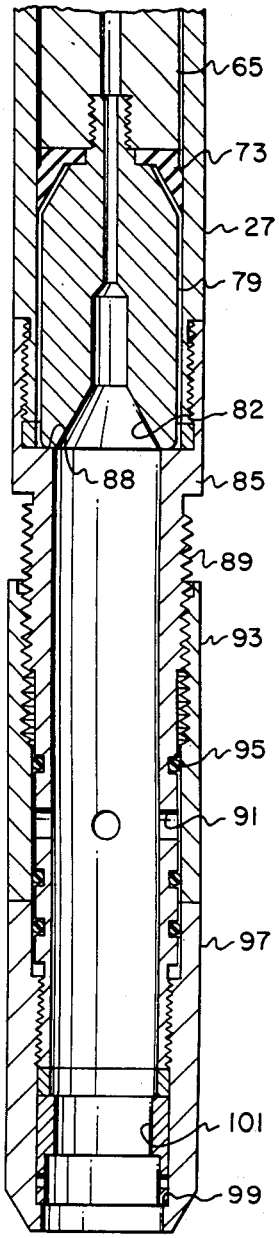
FIG. 5 shows a view of the lower portion of the dump bailer of FIG. 1, with the plug expelled, and the lower weight bar section in the lowermost position.

A shear ring sub 97 is screwed to the lower end of the sub 85. The shear ring sub 97 has a lower upwardly facing shoulder 99. Shoulder 99 retains therein a shear ring 101. The shear ring 101 is sealed by a seal 103 located at the top. A shear plug 105 is releasably inserted into the shear ring 101 and retained by a shear pin 107 that extends through holes in the plug 105 and the shear ring 101. An O-ring 109 seals the plug 105 within the shear ring 101. Under explosive force, the shear pin 107 shears and the plug 105 is expelled, as shown in FIG. 5. The plug 105, shear pin 107 and shear ring 101 serve as closure means for retaining the slurry within the housing 27 while the dump bailer 15 is lowered into the well, and for opening the lower end of the housing 27 to allow the slurry to be pushed out when the detonator 81 is ignited.

Figures 3A, 3B:
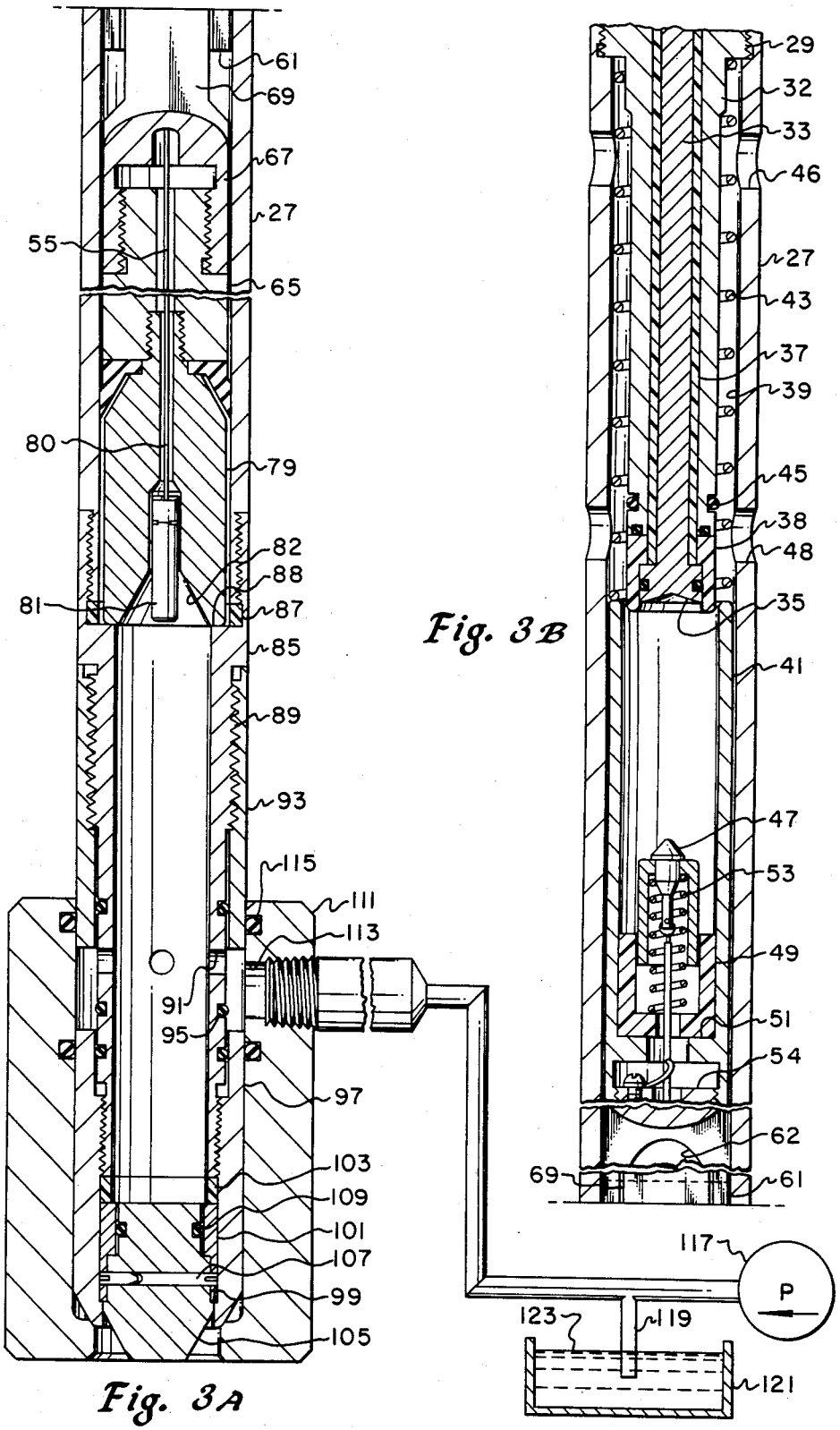
FIGS. 3A and 3B show portions of the dump bailer of FIG. 1 in the process of being filled with cement.

Referring to FIG. 3A, a charging adapter 111 is used when filling the lower chamber 77 with cement slurry. The charging adapter 111 has a passage therein that slidably receives the shear ring 101 and sleeve valve 93. A port 113 is located in the sidewall for registering with the port 91 when the sleeve valve 93 is moved to the upper position shown in FIG. 3A. O-rings 115 above and below the port 113 provide sealing.

A pump 117 is used to fill the lower chamber 77. The pump 117 has a suction intake 119 that extends into a slurry tank 121. A cement slurry 123 is located in the tank. Pump 17 will pump the slurry through the ports 113 and 91 into the lower chamber 77.

In the filling operation, the filling may take place while the dump bailer 15 is partially located within the lubricator (not shown). The lubricator may be suspended above the wellhead, normally by the workover or drilling ring. The dump bailer 15 will be connected by connector 18 to wireline 17 and suspended by a winch (not shown). The lower end of the housing 27 will be exposed below the lubricator. The detonator 81 is inserted into the blast sleeve 79 (FIG. 2C), and the leads 80 are connected to the wires 55 and 57 in the cavity 83. The upper weight bar section 54 and the lower weight bar section 65 are pushed into the housing 27 a short distance. The sub 85 is screwed onto the lower end of the housing and the charging adapter 111 is inserted over the sleeve valve 93.

A pump 117 is connected to the port 113, and normally some water will first be pumped into the lower chamber 77 through filler port 91. Then the cement slurry 123 is pumped into the lower chamber 77 below the water cushion, which will be considered a part of the slurry 123 for the purposes herein. The slurry 123 will flow around the blast sleeve 79 and push upwardly on the seal 73, causing the weight bar sections 54 and 65 to move upwardly. The lower contact 47 will contact the upper contact 35. The spring 43 will cushion the impact of the contacts 47 and 35.

When completely full of liquid, the seal 73 will be located immediately above the port 84, shown in FIG. 2C. Liquid will flow out the port 84, informing the operator that the lower chamber 77 is full of the slurry 123. The operator then removes the charging adapter 111 and moves the sleeve valve 93 to the lower closed position. At this point the weight bar sections 54 and 65 will be in the upper position as shown in FIGS. 2A and 2B, with the lower contact 47 engaging the upper contact 35. Spring 43 will be relaxed, not exerted any downward force on socket 41. Seal 45 will be holding the socket 41 in the upper position. The detonator 81 will be immersed in the liquid in the lower chamber 77.

The lubricator is then installed on the well, and the dump bailer 15 is lowered into the well. Normally, the well will be filled with a liquid, such as water. The well bore fluid in the tubing 13 enters the ports 46 and 48 (FIG. 2A), flows around the sleeve 41 around the upper weight section 54 and contacts the seal 73. This well bore fluid will be at the hydrostatic pressure of the fluid in the well. The ports 46 and 48, and the clearances around the weight bar sections 54 and 65, serve as equalizing means for applying hydrostatic force to the upper chamber 75. Hydrostatic force is also applied to the liquid in the lower chamber 77 through seal 73 and port 84 (FIG. 2C).

Often, the volume of the slurry 123 will shrink under hydrostatic pressure due to trapped gases in the slurry. When this occurs, the seal 73 will move downwardly under the gravity force of the lower weight bar section 65, maintaining the detonator 81 immersed in the slurry 123. The seal 73 may even move below the port 84 (FIG. 2C). If so, hydrostatic force will still be maintained in lower chamber 77 through the pressure in the upper chamber 75 acting on seal 73.

When the seal 73 and the lower weight bar section 65 move downwardly due to shrinkage in volume of slurry 123, the upper weight bar section 54 remains stationary relative to the housing 27. The O-ring 45 (FIG. 2A) serves as retention means to apply a frictional force to retain the upper weight bar section 54 in the upper position while the lower weight bar section 65 moves downwardly to account for shrinkage in the slurry 123. The upper weight bar section 54 must remain stationary to keep the lower contact 47 in engagement with the upper contact 35. The intermesing tines 61 and 69 allow the lower weight bar section 65 to move downwardly relative to the upper weight bar section 54.

After the dump bailer 15 passes below the tubing 13 and locates at the proper distance above the retainer 19, the operator applies electrical current from the surface to the wireline 17. The electrical current passes through the contact members 35 and 47 and to the detonator 81, causing it to explode. The detonator 81 will be fully immersed in the slurry 123, causing a shock wave to be directed downward through the cement slurry. This shock wave causes the shear pin 107 (FIG. 2D) to shear and the plug 105 to be expelled. The slurry 123 then is free to be pushed out.

The lower weight bar section 65 applies a positive force due to its weight against the cement slurry, pushing it downwardly. The lower weight bar section 65 will move downwardly relative to the upper weight bar section 54 until reaching the extended position shown in FIG. 4B. When the pin 71 contacts the pin 63, the upper weight bar section 54 will also begin to move downwardly. The force cause by the weight of the lower weight bar section 65, with the assistance of the spring 43, overcomes the frictional resistance of the O-ring 45 (FIG. 2A), to allow the downward movement of the upper weight bar section 54. Once socket 41 is past O-ring 45, the upper weight bar section 54 will quickly fall downwardly since it will no longer sealingly engage any stationary part of the dump bailer 15. When reaching the closed position such as shown in FIGS. 2A and 2B, it will strike the lower weight bar section 65. Both of the weight bar sections 54 and 65 will continue to move downwardly, pushing the cement slurry 123 from the tool until the blast sleeve 79 contacts the adapter 85, as shown in FIG. 5. The dump bailer 15 may then be pulled from the well for another run.

Once the dump bailer 15 reaches the surface, the lubricator will be lifted from the top of the wellhead and the dump bailer 15 lowered down to expose the housing 27 for another run, if necessary. The sub 85 is removed, and the entire weight bar assembly including the upper and lower weight bar sections 54 and 65, can be pulled from the tool and serviced for another run. The same or another weight bar assembly could be inserted into the housing 27 and the cycle repeated.

The invention has significant advantages. Being able to load the dump bailer from the bottom speeds up the process of filling the tool. The extensible weight bar assembly allows the upper contact to remain in tight engagement with the contact on the weight bar even though shrinkage of the slurry may occur. Use of a shock wave to expel a plug avoids the need for wires to extend through the slurry. The dump bailer can be reloaded with a detonator and refilled with slurry without having to remove the dump bailer from the lubricator.

While the invention has been shown in only one of its forms, it should be apparent to those skilled in the art that it is not so limited, but is susceptible to various changes without departing from the scope of the invention.

We claim:

1. A dump bailer adapted to be lowered on a wireline into a well for placing a slurry on a retainer positioned in the well, comprising in combination:

a tubular housing;

a weight bar carried in the housing for axial movement relative thereto between upper and lower positions;

means for mounting an electrically ignited detonator to the bottom of the weight bar;

port means for introducing the slurry into the housing below the weight bar and for immersing the detonator in the slurry when the weight bar is in the upper position;

means for electrically connecting the detonator to the wireline to ignite the detonator;

a plug releasably inserted into the lower end of the housing to retain the slurry in the housing when the weight bar is in the upper position; and shear means for allowing the plug to be expelled from the housing due to the explosive force of the detonator when ignited transmitting a shock wave through the slurry, allowing the weight bar to move to the lower position to push the slurry from the housing.

2. A dump bailer adapted to be lowered on a wireline into a well for placing a cement slurry on a retainer positioned in the well, comprising in combination:

a tubular housing;

an electrical upper contact mounted in the housing and facing downwardly;

means for electrically connecting the upper contact to the wireline and for receiving electrical current;

a weight bar slidably carried in the housing between upper and lower positions;

a contact member carried on the upper end of the weight bar having a lower contact on its upper end which faces upwardly for electrical engagement with the upper contact when the weight bar is in the upper position;

seal means on the weight bar for sealing the weight bar in the housing, defining upper and lower chambers;

a detonator electrically connected to the lower contact and carried at the lower end of the weight bar below the seal means;

lower port means in the housing for pumping slurry into the lower chamber into contact with the seal means, and for pushing the weight bar and the contact member upwardly with the slurry to the upper position of the weight bar, causing the lower contact to engage the upper contact, and immersing the detonator in the slurry so as to create a shock wave through the slurry when the detonator is ignited;

upper port means for applying hydrostatic force to the upper chamber, the weight bar being moveable downwardly in the housing to maintain the seal means in contact with the slurry and the detonator immersed in the slurry should the slurry volume shrink under hydrostatic force; and closure means on the lower end of the housing for retaining the slurry within the housing while running the dump bailer into the well, and for opening the lower end of the housing to allow the weight bar to move to the lower position to push the slurry from the housing upon ignition of the detonator and due to the shock wave being transmitted through the slurry.

3. The dump bailer according to claim 2, further comprising bias means engaging at least one of the electrical contacts for yielding urging the electrical contacts toward each other.

4. The dump bailer according to claim 2 wherein the closure means comprises a plug releasably inserted into the lower end of the housing; and shear pin means for releasing the plug upon exposure to the explosive force which passes through the slurry and is created by ignition of the detonator.

5. The dump bailer according to claim 2, wherein the detonator is mounted in a sleeve located at the lower end of the weight bar, the sleeve having a conical downwardly facing cavity surrounding at least the lower portion of the detonator to direct the explosive force of the detonator downwardly into the slurry.

6. A dump bailer adapted to be lowered on a wireline into a well for placing a cement slurry on a retainer positioned in the well, comprising a combination:

a tubular housing;

an electrical upper contact mounted in the housing and facing downwardly;

means for electrically connecting the upper contact to the wireline and for receiving electrical current;

a weight bar slidably carried in the housing between upper and lower positions;

a contact member carried on the upper end of the weight bar having a lower contact on its upper end which faces upwardly for electrical engagement with the upper contact when the weight bar is in the upper position;

seal means on the weight bar for sealing the weight bar in the housing, defining upper and lower chambers;

a detonator electrically connected to the lower contact and carried at the lower end of the weight bar below the seal means;

lower port means in the housing for pumping slurry into the lower chamber into contact with the seal means, and for pushing the weight bar and the contact member upwardly with the slurry to the upper position of the weight bar, causing the lower contact to engage the upper contact, and immersing the detonator in the slurry so as to create a shock wave through the slurry when the detonator is ignited;

upper port means for applying hydrostatic force to the upper chamber;

a plug releasably inserted into the lower end of the housing to retain the slurry in the housing when the weight bar is in the upper position; and shear means for allowing the plug to be expelled from the housing due to the explosive force of the detonator when ignited transmitting a shock wave through the slurry, allowing the weight bar to move to the lower position to push the slurry from the housing.

7. The dump bailer according to claim 6, further comprising:

communication port means located at the top of the lower chamber, the seal means being located above the communication port means when the weight bar is in the upper position, for applying hydrostatic force to the lower chamber when the weight bar is in the upper position.

8. A dump bailer adapted to be lowered on a wireline into a well for placing cement slurry on a retainer positioned in the well, comprising in combination:

a tubular housing;

a tubular member mounted in the upper end of the housing and being of smaller outer diameter than the inner diameter of the housing, defining a clearance;

an electrical upper contact mounted to the lower end of the tubular member, insulated therefrom, and facing downwardly;

means for electrically connecting the upper contact to the wireline;

an upper weight bar section slidably carried in the housing;

a socket mounted to the upper end of the upper weight bar section for movement therewith, and adapted to extend into the clearance;

an electrical lower contact mounted in the socket and facing upwardly for electrically engaging the upper contact when the upper weight bar section is in an upper position;

a lower weight bar section slidably carried in the housing below the upper weight bar section;

connection means for slidably connecting the weight bar sections together, to allow a selected amount of downward movement of the lower weight bar section relative to the upper weight bar section;

lower seal means located on the lower weight bar section for sealing the lower weight bar section within the housing, defining upper and lower chambers;

means for mounting an electrical detonator to the bottom of the lower weight bar section below the seal means and electrically connected to the lower contact;

lower port means in the housing for pumping slurry into the lower chamber of the housing and into contact with the detonator, for pushing each of the weight bar sections upwardly, with the contacts coming into electrical engagement with each other when the lower chamber is full of slurry;

upper port means in the housing for admitting well bore fluid to the upper chamber to apply hydrostatic force to the upper chamber;

upper seal means located between the socket and the tubular member to retain the upper weight bar section and prevent it from moving downwardly should the lower weight bar section move downwardly due to shrinkage in volume of the slurry in the lower chamber due to hydrostatic force while lowering the dump bailer into the well;

a plug releasably inserted into the lower end of the housing;

shear means for allowing the plug to be expelled from the housing due to the explosive force of the detonator being transmitted through the slurry;

the weight of the lower weight section being sufficient to pull the upper weight section from the retention of the upper seal means, allowing the upper weight bar section to move downwardly to assist the lower weight bar section in pushing the slurry from the lower chamber when the plug is expelled.

* * * * *